US012102239B2

(12) United States Patent
Dodge

(10) Patent No.: US 12,102,239 B2
(45) Date of Patent: Oct. 1, 2024

(54) BABY SLING

(71) Applicant: Katherine Dodge, Post Falls, ID (US)

(72) Inventor: Katherine Dodge, Post Falls, ID (US)

(73) Assignee: Indago Sling Studios, Inc., La Mesa, CA (US)

( * ) Notice: Subject to any disclaimer, the term of this patent is extended or adjusted under 35 U.S.C. 154(b) by 0 days.

(21) Appl. No.: 17/955,467

(22) Filed: Sep. 28, 2022

(65) Prior Publication Data

US 2023/0101744 A1 Mar. 30, 2023

Related U.S. Application Data

(60) Provisional application No. 63/250,026, filed on Sep. 29, 2021.

(51) Int. Cl.
*A47D 13/02* (2006.01)
*A41D 1/21* (2018.01)

(52) U.S. Cl.
CPC ..... *A47D 13/02* (2013.01); *A41D 1/21* (2018.01); *A41D 2400/482* (2013.01)

(58) Field of Classification Search
CPC ..... A47D 13/02; A47D 13/025
USPC ..... 224/158, 159
See application file for complete search history.

(56) References Cited

U.S. PATENT DOCUMENTS

| | | | | | |
|---|---|---|---|---|---|
| 5,950,887 | A * | 9/1999 | Powell | A47D 13/025 | 224/159 |
| 6,065,655 | A * | 5/2000 | Parewick | A47D 13/025 | 224/159 |
| 9,380,886 | B2 * | 7/2016 | Rahni | A47D 13/02 | |
| 2006/0237493 | A1 * | 10/2006 | Tsai | A47D 13/025 | 224/159 |
| 2015/0189997 | A1 * | 7/2015 | Gmeiner | A47D 13/02 | 224/158 |
| 2023/0101744 | A1 * | 3/2023 | Dodge | A47D 13/02 | 224/159 |

FOREIGN PATENT DOCUMENTS

| | | | | |
|---|---|---|---|---|
| CA | 3014092 | A1 * | 2/2020 | |
| CN | 2836630 | Y * | 11/2006 | |
| CN | 201104679 | Y * | 8/2008 | A47D 13/025 |
| JP | 2003047542 | A * | 2/2003 | A47D 13/025 |

* cited by examiner

*Primary Examiner* — Justin M Larson
(74) *Attorney, Agent, or Firm* — Richard T. Black; FisherBroyles, LLP

(57) ABSTRACT

An adjustable single-fabric self-cushioned distributed load comfort baby sling.

1 Claim, 20 Drawing Sheets

Physical Construction Steps:

1: Long rectangular piece of fabric.

2: Outer edges are folded inward and meet in the middle.

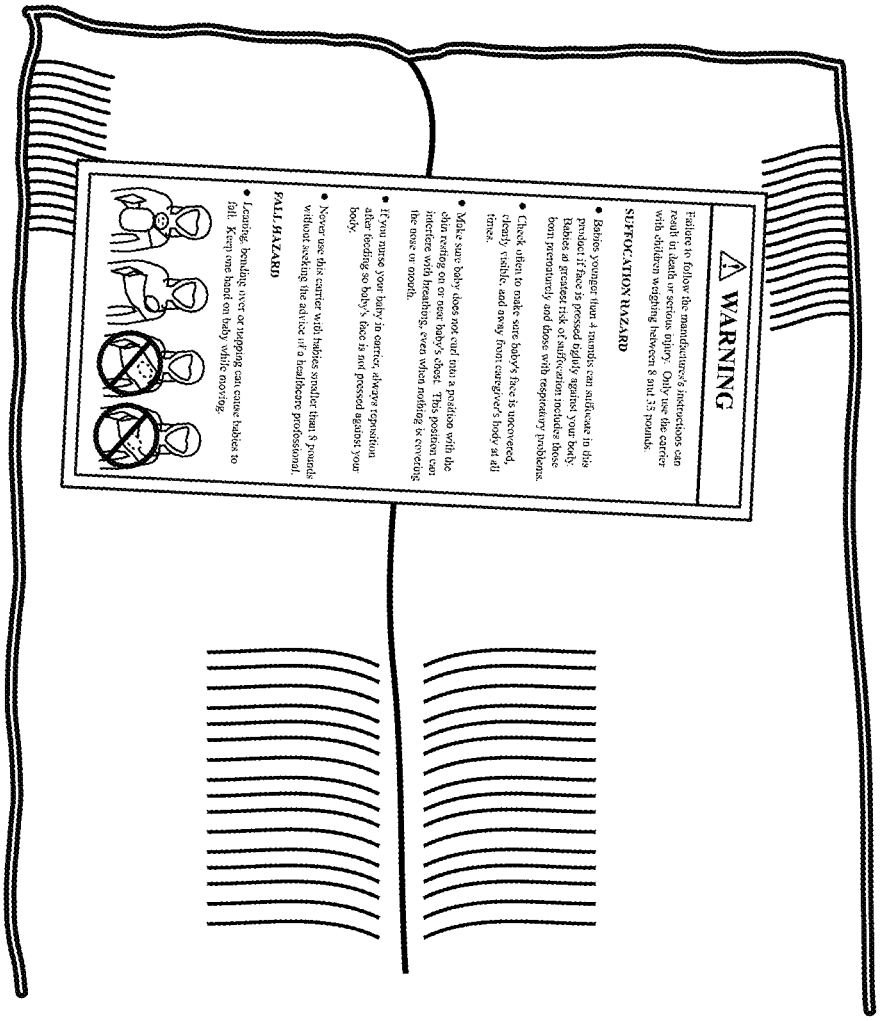

⚠ WARNING

Failure to follow the manufacturer's instructions can result in death or serious injury. Only use the carrier with children weighing between 8 and 35 pounds.

SUFFOCATION HAZARD

- Babies younger than 4 months can suffocate in this product if face is pressed tightly against your body. Babies at greatest risk of suffocation includes those born prematurely and those with respiratory problems.
- Check often to make sure baby's face is uncovered, clearly visible, and away from caregiver's body at all times.
- Make sure baby does not curl into a position with the chin resting on or near baby's chest. This position can interfere with breathing, even when nothing is covering the nose or mouth.
- If you nurse your baby in carrier, always reposition after feeding so baby's face is not pressed against your body.
- Never use this carrier with babies smaller than 8 pounds without seeking the advice of a healthcare professional.

FALL HAZARD

- Leaning, bending over or napping can cause babies to fall. Keep one hand on baby while moving.

*Fig. 12*

⚠ WARNING

Failure to follow the manufacturer's instructions can result in death or serious injury. Only use this carrier with children weighing between 8 and 35 pounds.

SUFFOCATION HAZARD

- Babies younger than 4 months can suffocate in this product if face is pressed tightly against your body. Babies at greatest risk of suffocation include those born prematurely and those with respiratory problems.
- Check often to make sure baby's face is uncovered, clearly visible, and away from caregiver's body at all times.
- Make sure baby does not curly into a position with the chin resting on or near baby's chest. This position can interfere with breathing, even when nothing is covering the nose or mouth.
- If you nurse your baby in carrier, always reposition after feeding so baby's face is not pressed against your body.
- Never use this carrier with babies smaller than 8 pounds without seeking the advice of a healthcare professional

FALL HAZARD

- Leaning, bending over, or tripping can cause baby to fall. Keep one hand on baby while moving.

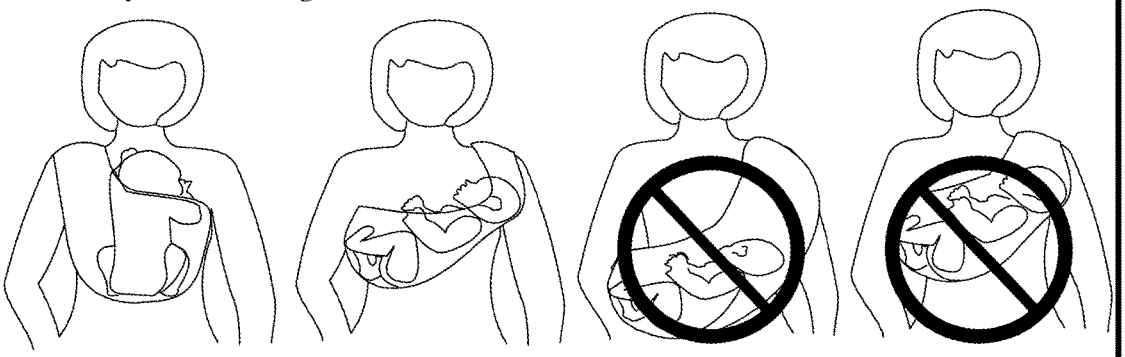

| Correct: Upright (optimal) Chin up, face visible Nose and mouth free | Correct: Reclined Chin up; face visible Nose and mouth free | Incorrect: Baby's face covered and pressed tight against wearer | Incorrect: Baby is hunched with chin touching chest; face covered |
|---|---|---|---|

bciaJan20

*Fig. 20*

BABY SLING

PRIORITY CLAIM

This application claims priority to U.S. Provisional Patent Application Ser. No. 63/650,026 filed Sep. 29, 2021, the contents of which are hereby incorporated by reference in their entirety as if fully set forth herein.

COPYRIGHT NOTICE

This disclosure is protected under United States and/or International Copyright Laws.© 2022 INDAGO SLING STUDIOS, LLC. All Rights Reserved. A portion of the disclosure of this patent document contains material which is subject to copyright protection. The copyright owner has no objection to the facsimile reproduction by anyone of the patent document or the patent disclosure, as it appears in the Patent and/or Trademark Office patent file or records, but otherwise reserves all copyrights whatsoever.

BACKGROUND

Traditional baby slings sew their slings into a gathered or pleated, shoulder. This requires the wearer to make many adjustments to the fabric, there is too much cumbersome, uncomfortable fabric in the shoulder area, and not enough support to the shoulder and distributed throughout the wearer's back. Pleated designs that narrow the shoulder have lots of pressure points and the pleats are often bulky and uncomfortable. These designs often have varying levels of cushioning or padding throughout. Some add an extra layer of padded material different from the fabric/material in the rest of the sling. Therefore, there is a need for a sling baby carrier that is easier to adjust properly and provide extra cushion on the shoulder area of the wearer, making it more comfortable to wear.

BRIEF DESCRIPTION OF THE DRAWING FIGURES

FIG. 12 illustrates a safety warning label is sewn on the underside of the baby sling fabric according to an embodiment;

Figure 19:
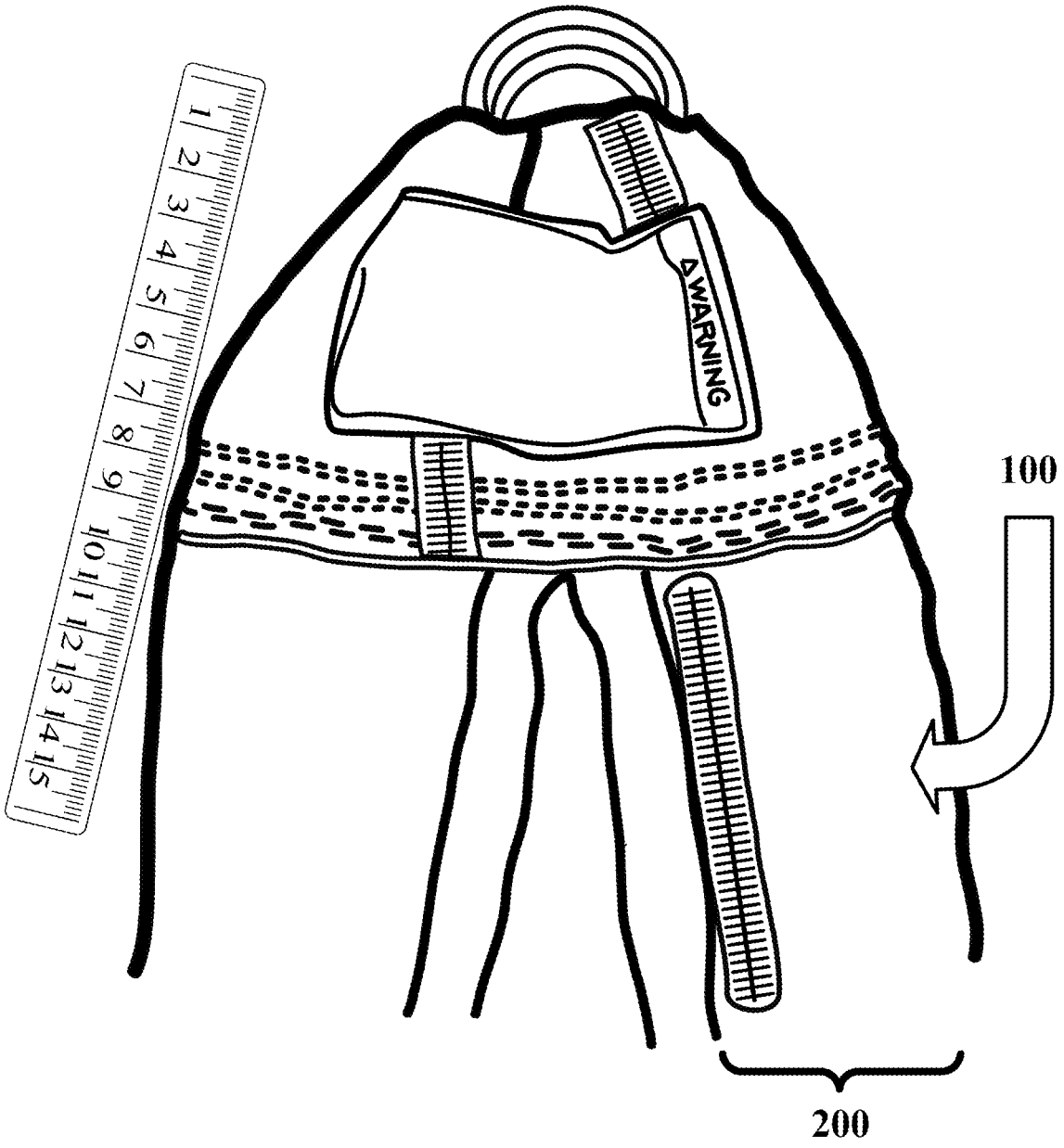

FIG. 19 also illustrates folding and sewing method creates horizontal hammock to accommodate secure baby placement; doubled up layers of fabric formed by the folds to create extra cushion for a wearer and narrowed width of the fabric formed by the folds through the connecting rings to avoid pressing against the wearer's neck or fall to the wearer's shoulder according to an embodiment;

FIG. 20 illustrates a safety warning label with usage instructions for a wearer.

DETAILED DESCRIPTION

This application is intended to describe one or more embodiments of the present invention. It is to be understood that the use of absolute terms, such as "must," "will," and the like, as well as specific quantities, is to be construed as being applicable to one or more of such embodiments, but not necessarily to all such embodiments. As such, embodiments of the invention may omit, or include a modification of, one or more features or functionalities described in the context of such absolute terms. In addition, the headings in this application are for reference purposes only and shall not in any way affect the meaning or interpretation of the present invention.

Embodiments of the invention comprise a sling baby carrier that is easier for a user to adjust properly and to provide extra cushion on the shoulder area of the wearer, making it more comfortable to wear than prior slings. The shoulder design where the rings are sewn in is designed to make the shoulder portion less than half the width of a typical sling shoulder portion so the shoulder fabric requires minimal or no adjustment when worn. The folding techniques used in embodiments of the invention create a continuous fold and the same number of layers of fabric across the entire shoulder, which results in even cushioning and minimal pressure points.

Figure 1:
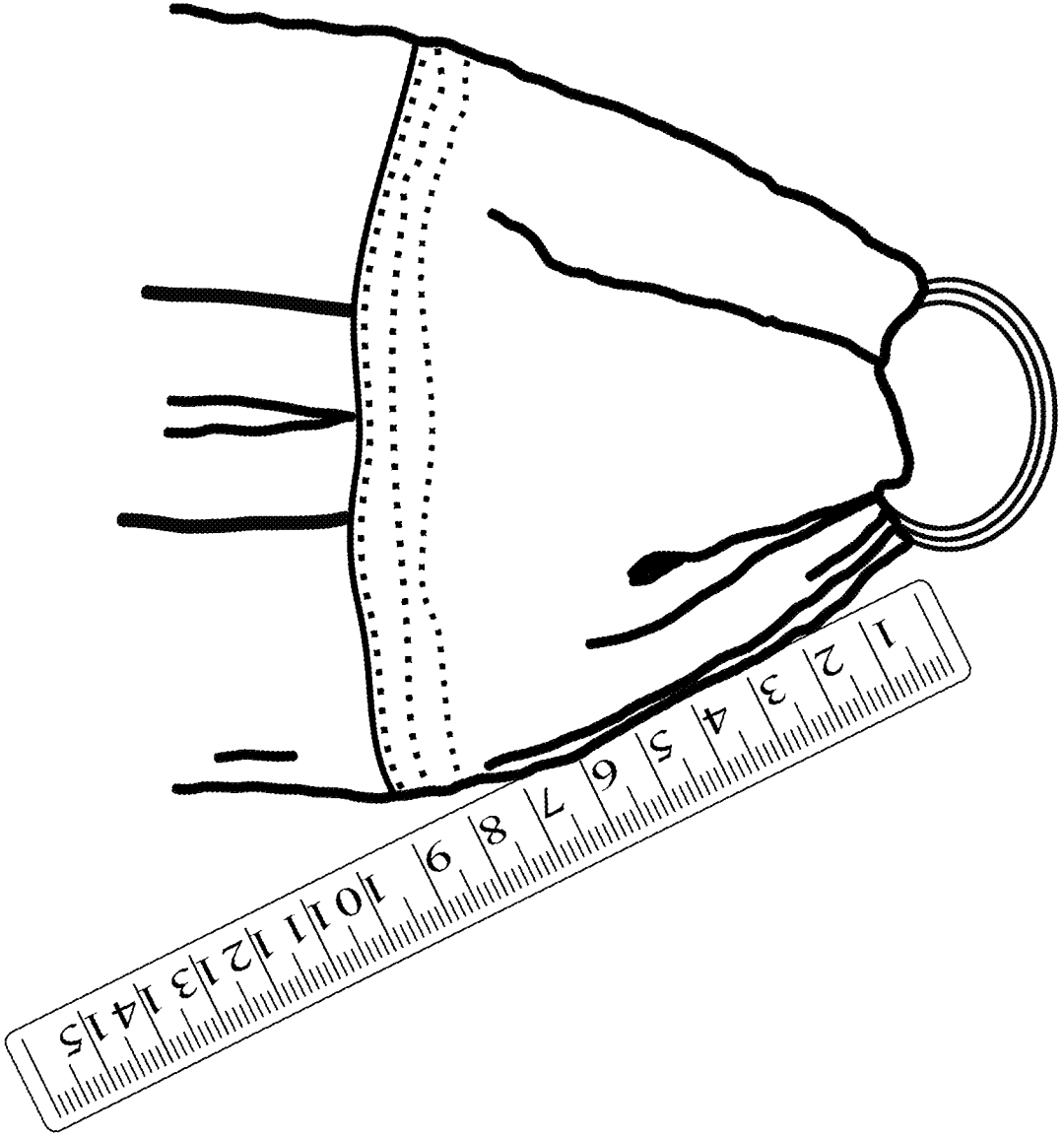
FIG. 1 illustrates a front plan view of top portion of a baby sling and connecting ring according to an embodiment.

The fabric is folded inwards and then back out again with an opening in the middle of the carrier, creating extra cushioning in the form of multiple layers (for example, 4 layers) of fabric in the shoulder area of the sling. The shoulder area where the fabric is folded and sewn is also longer than a typical sling shoulder so that the extra layers of fabric extend past the wearers shoulder and into their back. For example, in one preferred embodiment, the multiple layers folded and sewn portion is at least 9 inches long as shown in FIG. 1. This makes the sling more comfortable and supportive because the 4 layers of fabric that create a cushion extend all the way over the back of the wearers shoulder an into their back. Where the multilayered shoulder area of the sling stops, it fans out to create equal weight distribution along the wearer's back.

The main features of the invention include, but are not limited to: fabric layers folded and doubled up to provide more support and cushion to the wearer; a narrower shoulder profile which is elongated and extended so that the fabric is doubled-up, it extends over the entire shoulder and back, and provides a larger area of cushion for better weight distribution on the wearer's back; and, the layers of fabric fold back toward the outside of the sling so that the fabric can easily fan out and lay flat against the back of the wearer. The padded area providing support extends more than other prior sling designs on the market, opens easily in the middle to accommodate the baby, and the extended shoulder provides extra support and cushion further back into the shoulder and into the back of the wearer.

Figure 2:
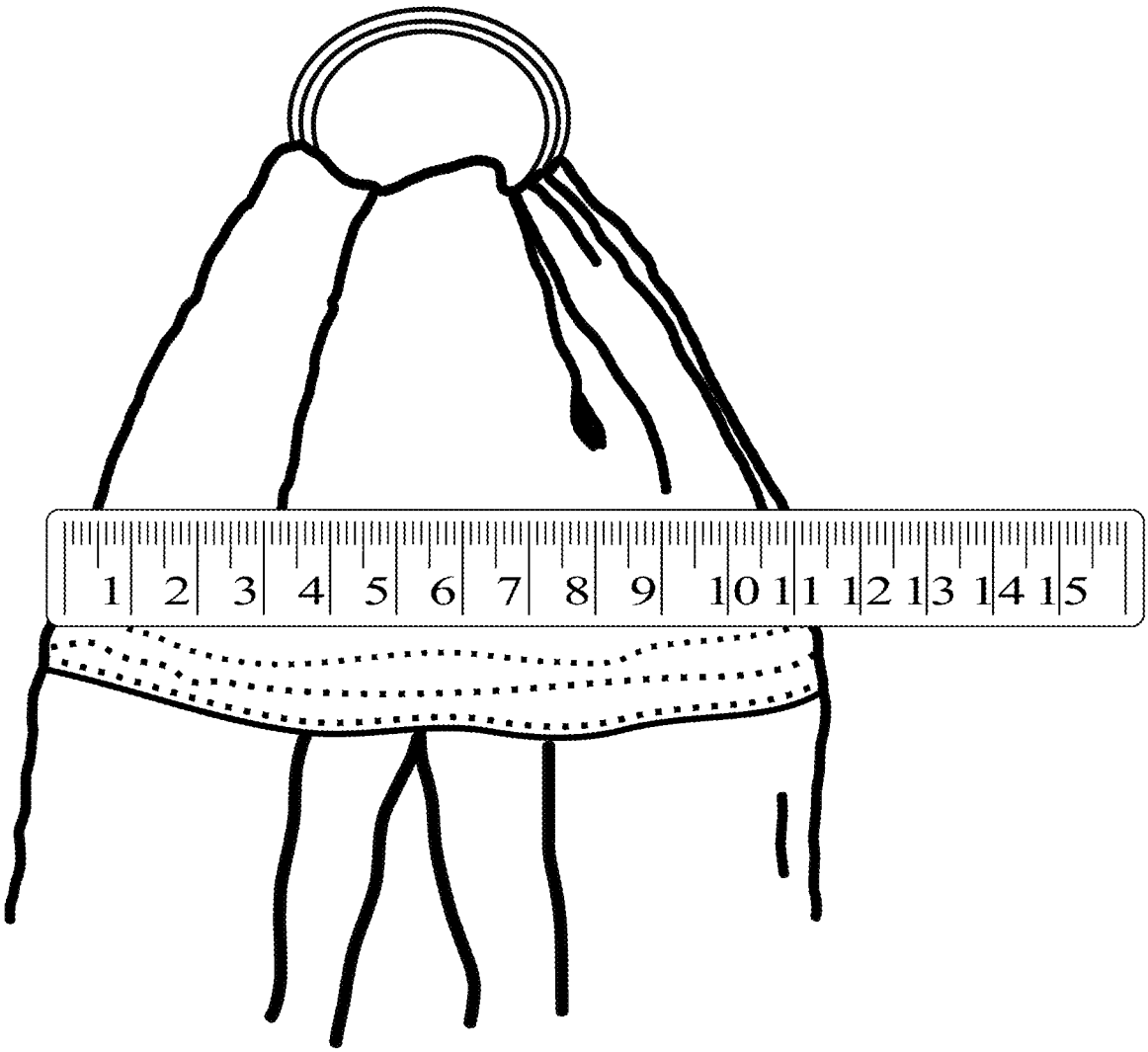
FIG. 2 illustrates another front plan view of top portion of a baby sling, a dimension, and a connecting ring according to an embodiment.
Figure 3:
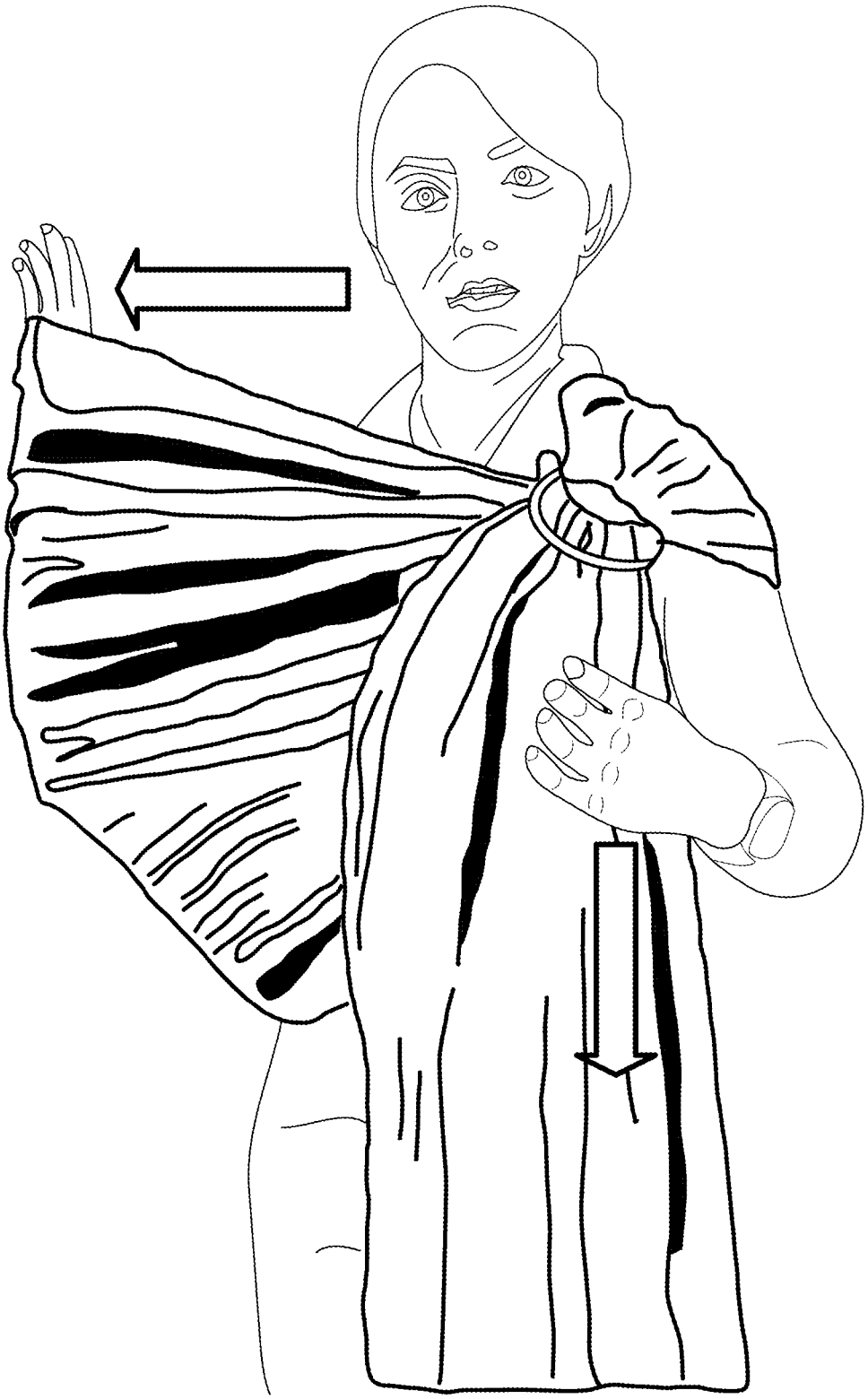
FIG. 3 illustrates a front plan view of a baby sling and a connecting ring being arranged and worn by a user and according to an embodiment.
Figure 4:
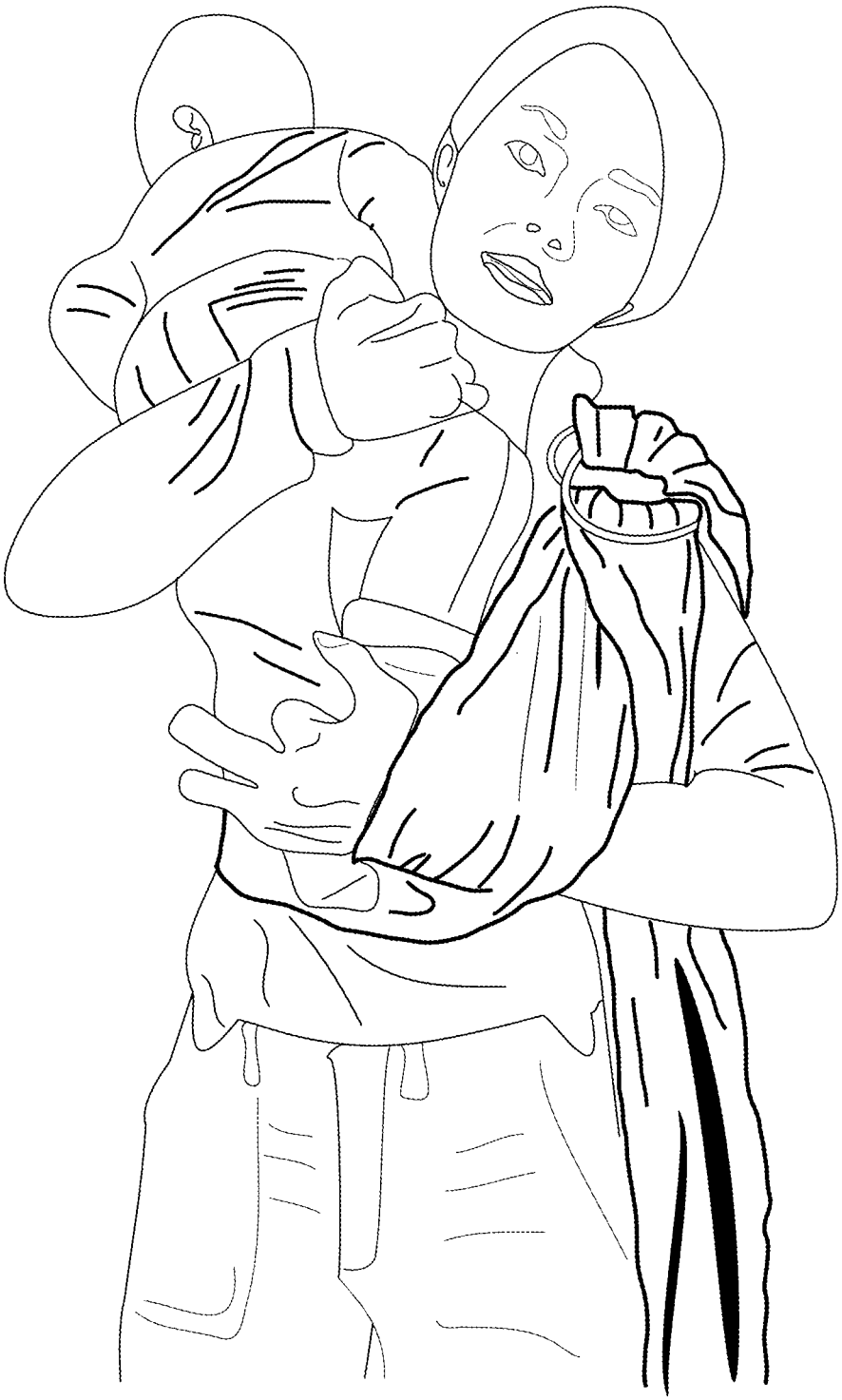
FIG. 4 illustrates a front plan view of a baby being initially loaded into a baby sling by a user according to an embodiment.
Figure 5:
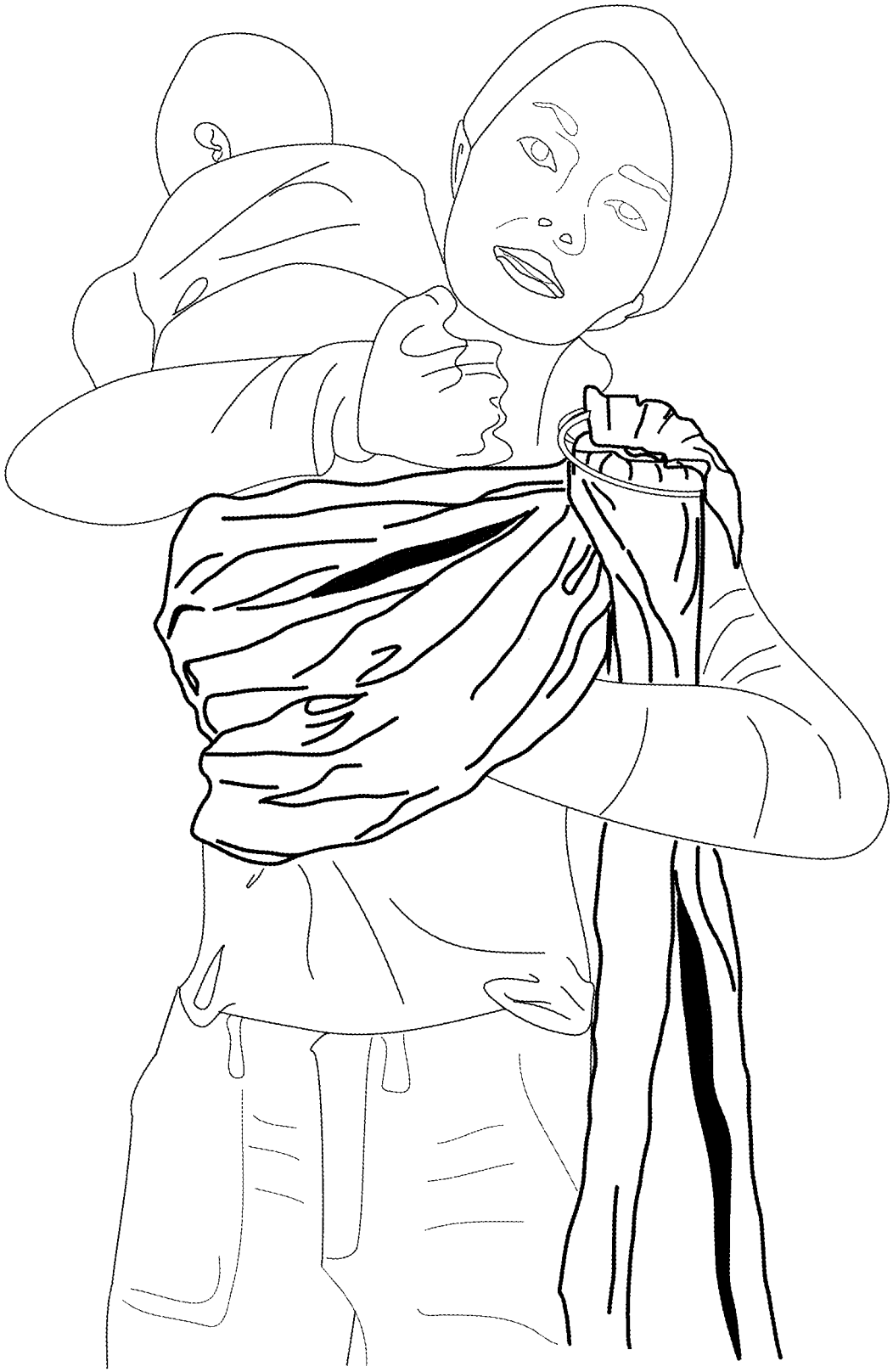
FIG. 5 illustrates a front plan view of a baby being further loaded into a baby sling by a user according to an embodiment.
Figure 8:
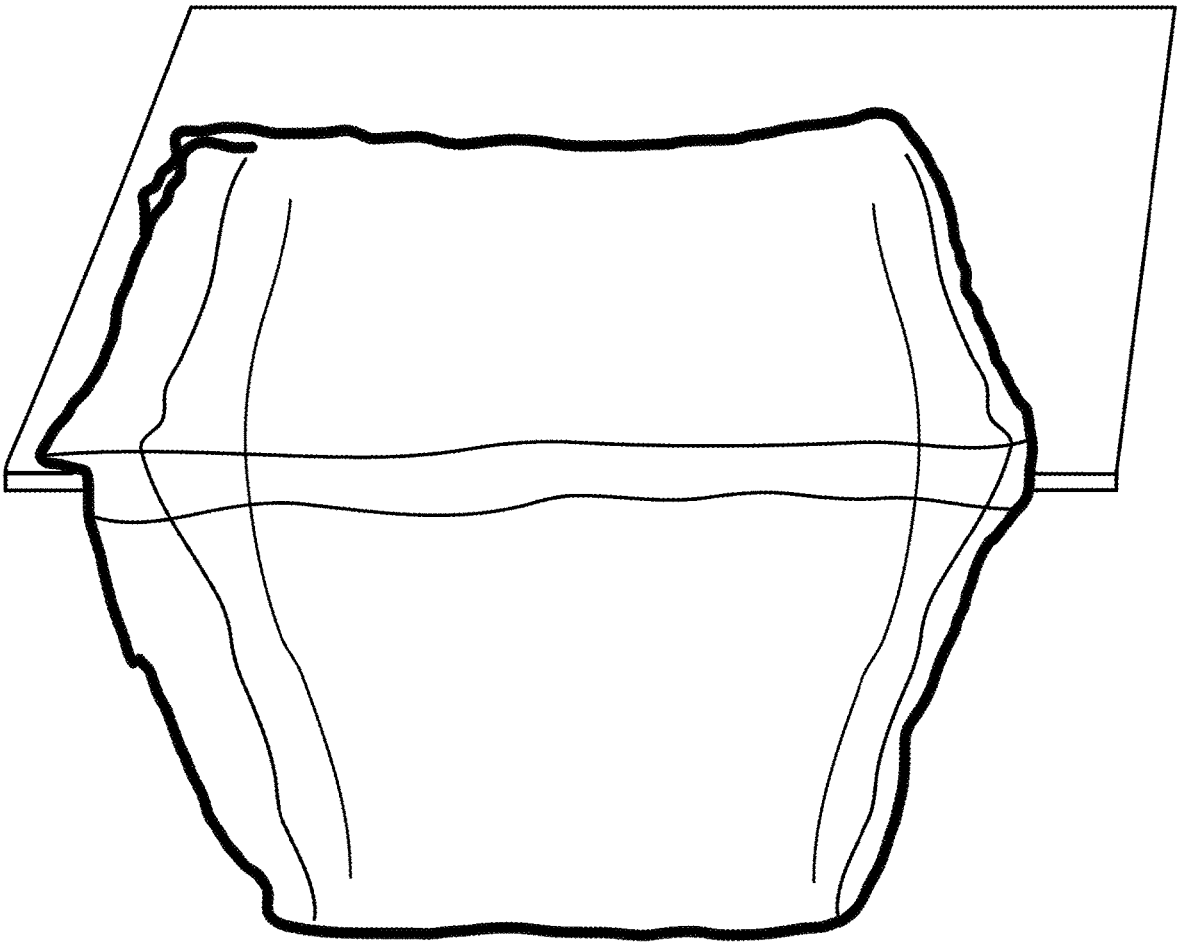
FIG. 8 illustrates a rectangular piece of fabric draped over a horizontal surface prior to folding and sewing into a baby sling configuration by a user according to an embodiment.

Referring now to FIGS. 1 and 2, in one embodiment of the invention, a piece of fabric is attached to two rings on the end. These two connecting rings are preferably of aluminum, but could be of any metal, or any type of plastic, fiberglass or any other material. As shown in FIG. 8, the fabric is optimally one long rectangular, continuous piece and it is folded inward and then back out slightly, to create extra cushion in the shoulder. The fabric is folded inward and then back out and then pulled through the rings and sewn down in the triple seam. The invention opens in the middle, creating a sling (or pocket) where the baby will rest in an upright position.

Additional features of the baby carrier include an extended shoulder area, it is optimally sewn extra-long so it will provide extra cushioning throughout the shoulder of the wearer. The fabric continues, extending behind the shoulder and into the back so the fabric provides extra cushion and support in the shoulder and into the wearer's back.

In use, the sling is put over the top of the shoulder, and then if you turn around, where the shoulder of the sling ends, where the stitching ends, the sling will standout from the wearer's back to create equal weight distribution across the back. The fabric fans out in layers, then is brought around the wearer and then the fabric is threaded through the two connecting rings, first all the way through the entire length of the fabric, and then threaded back through the bottom ring only. This creates a harness to hold the fabric in place. The fabric is adjustable for comfort and creates a pocket or sling for the baby to fit in. In use, the pocket generally sits on the front of the wearer to keep the baby close to the wearer's face. In alternate embodiments and uses, the baby sling can be worn on the side or the back.

The shoulder area has extra extended cushioning for better comfort than prior slings. Embodiments of the invention feature an extended cushion, extended doubled-up layers of fabric over the shoulder and into the back, with a narrow shoulder profile so it essentially takes a minimal adjustment to the sling covering the shoulder. This extended cushioned area features a narrow profile so that when the wearer puts it on, minimal adjustment is required, and extra cushion and comfort for the wearer is provided throughout the shoulder and into the back. The folding technique used creates a continuous fold and the same number of layers of fabric across the entire shoulder, which results in even cushioning and minimal pressure points on the wearer.

In one embodiment of the invention, the shoulder section is folded inward and meets in the middle so that it features 4 continuous layers of fabric (in the shoulder area). This acts as cushioning for the wearer. The middle three inches of the sling shoulder area can have 6 layers (due to the fabric being folded back towards the outer edges). The sling carrier is constructed with an opening in the middle so that it functions the same when worn on either shoulder.

Figure 6:
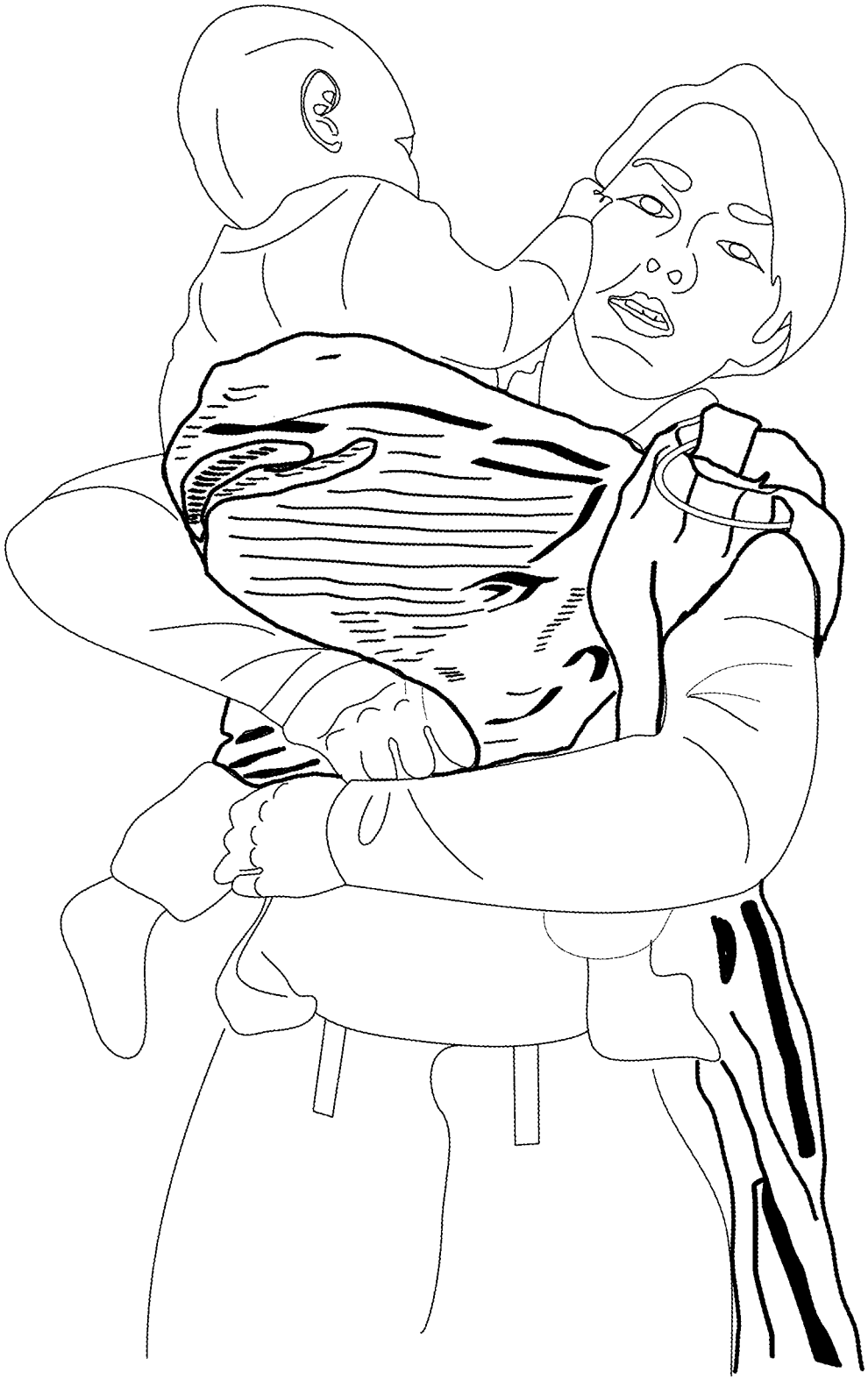
FIG. 6 illustrates a front plan view of a baby being further loaded into a baby sling and having his or her feet properly arranged by a user according to an embodiment.
Figure 7:
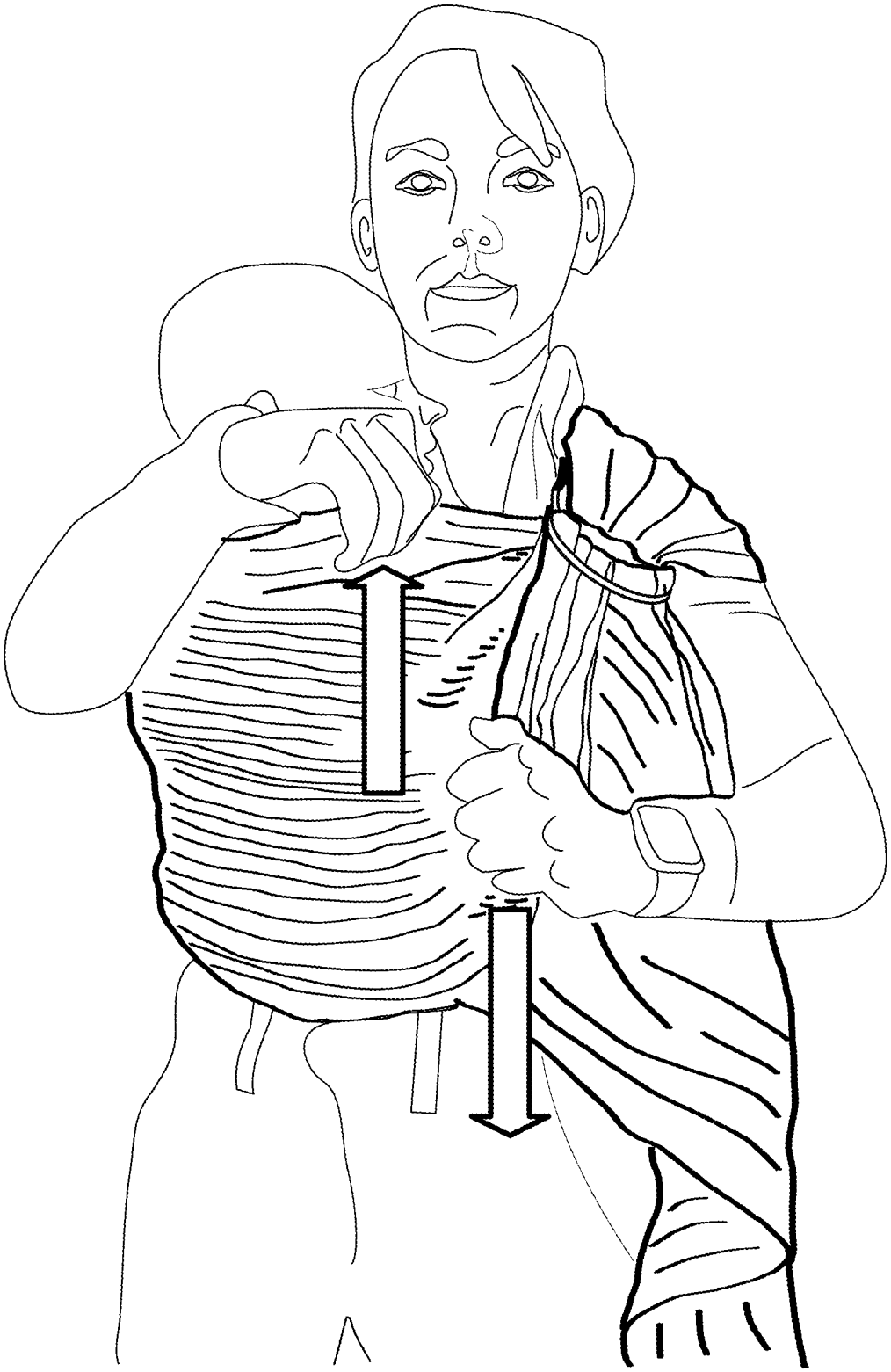
FIG. 7 illustrates a front plan view of a baby being completely loaded into a baby sling by a user, and being adjusted to hold the baby safely and securely according to an embodiment.

Referring now to FIGS. 6 and 7, embodiments include a multiple baby position baby pocket. In use, in one embodiment, the sling forms an aperture that holds the baby enabling the baby to sit upright. The baby sits upright on the front of the wearer, stomach-to-stomach with the wearer. The wearer fits the baby in the pocket of the carrier. The baby's legs are settled into the pocket, or dangle out of the pocket, creating a nice, secure sling/pocket for them to sit in so the baby sits stomach-to-stomach with the wearer and upright, not reclined.

In some embodiments, a preferred method of physical construction steps is as follows. First, as shown in FIG. 8, a long rectangular piece of fabric is draped over a horizontal surface for positioning for further work. Next, as shown in FIG. 9, the outer edges are folded inward to meet in the middle, adjacent and collinearly.

Figure 9:
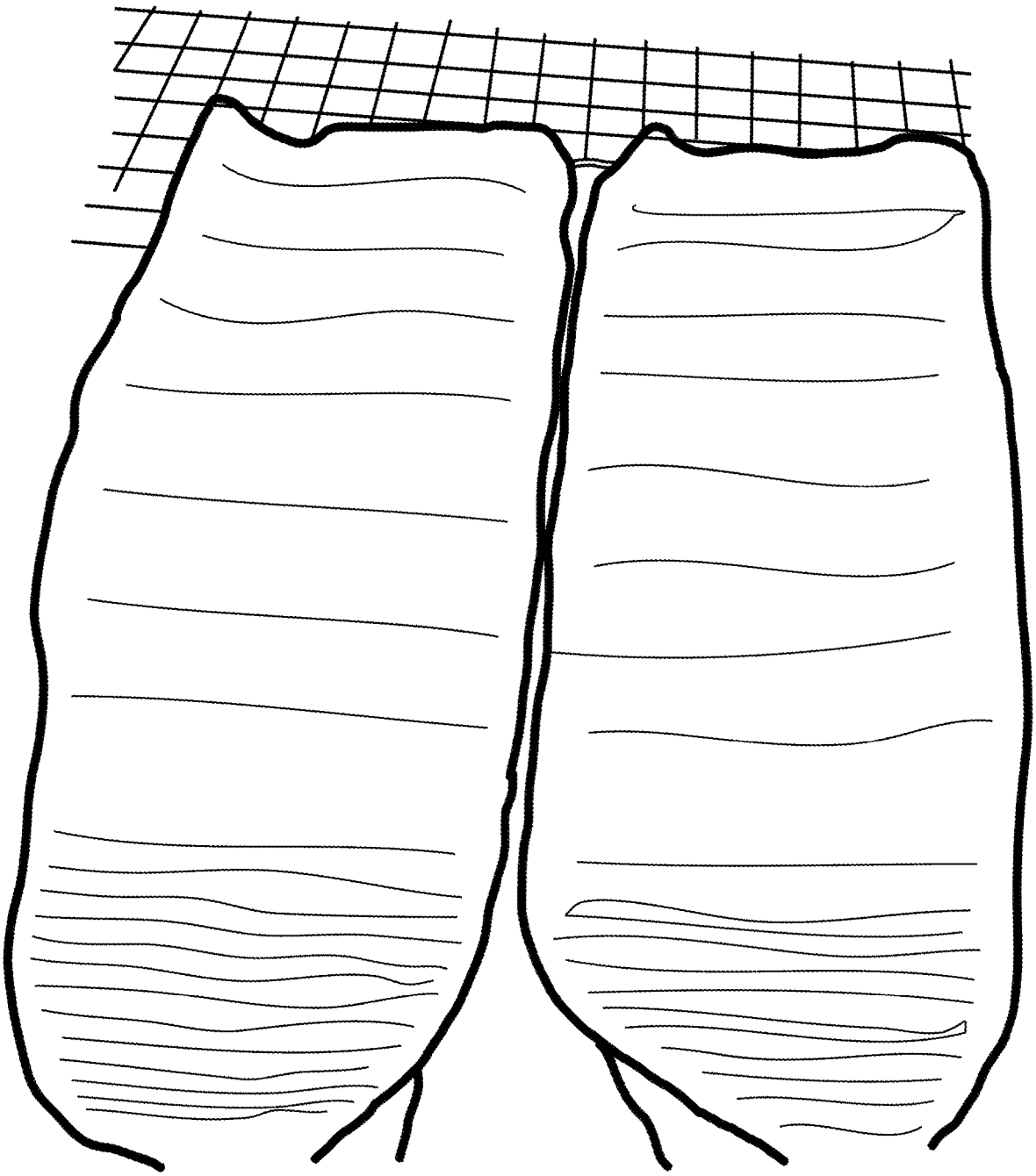
FIG. 9 illustrates the outer edges of the rectangular piece of fabric of FIG. 8 having been folded inward to meet adjacent and collinear in the middle of the fabric according to an embodiment.
Figure 10:
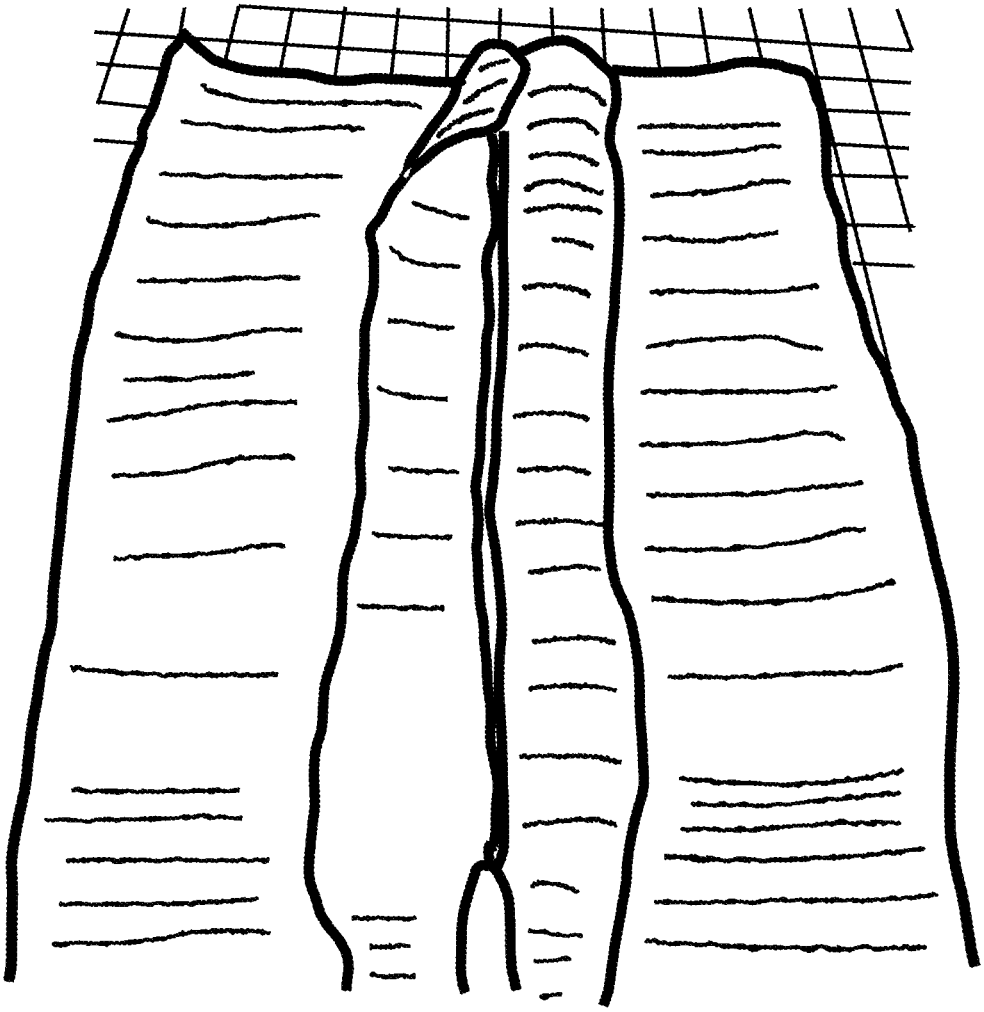
FIG. 10 illustrates the adjacent collinear outer edges of the rectangular piece of fabric of FIG. 9 having been folded back outwards again by about 1.5 inches and pressed flat, with the inner edges of the fold are pulled together so they are adjacent touching in the middle according to an embodiment.

Next, as shown in FIG. 10, the adjacent outer edges of FIG. 9 are then folded back about 1.5 inches and pressed flat, and the resultant folds are then pulled together to be adjacent and collinear.

Figure 11:
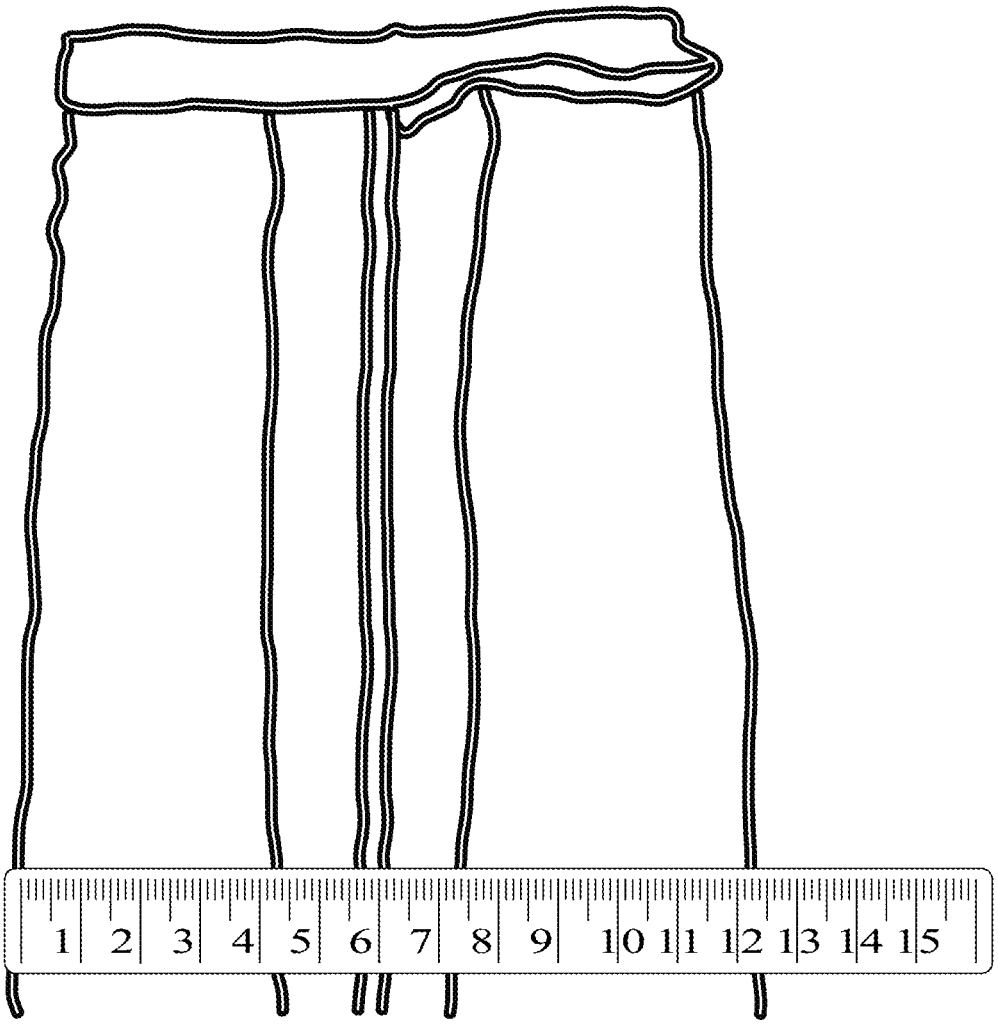
FIG. 11 illustrates the top edge having been folded down perpendicularly to the previous folds of FIGS. 9 and 10 by about 2 inches according to an embodiment.

Next, as shown in FIG. 11, the top edge is folded down, about 2 inches, and perpendicular to the previous folds. Then, or in some embodiments before, a warning label may be sewn on the underside of the fabric as shown in FIG. 12.

Figure 13:
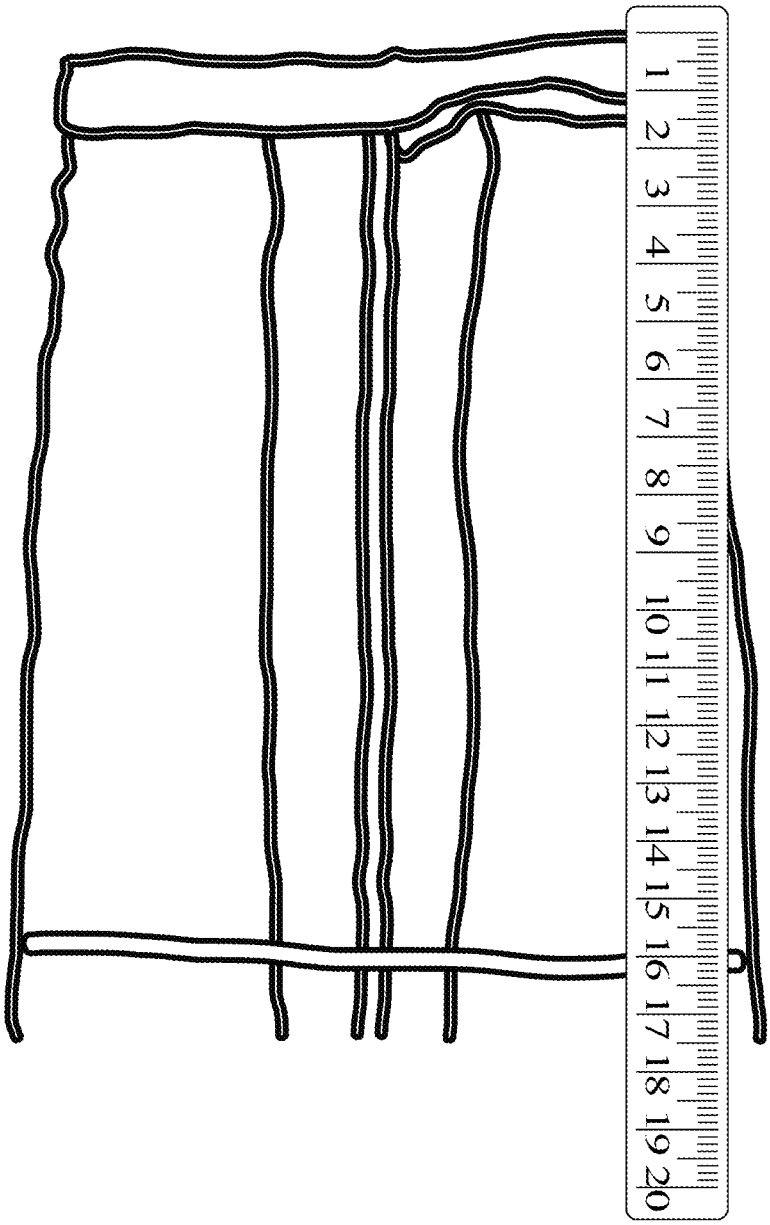
FIG. 13 illustrates a line having been marked at about 16 inches from the top edge according to an embodiment.
Figure 14:
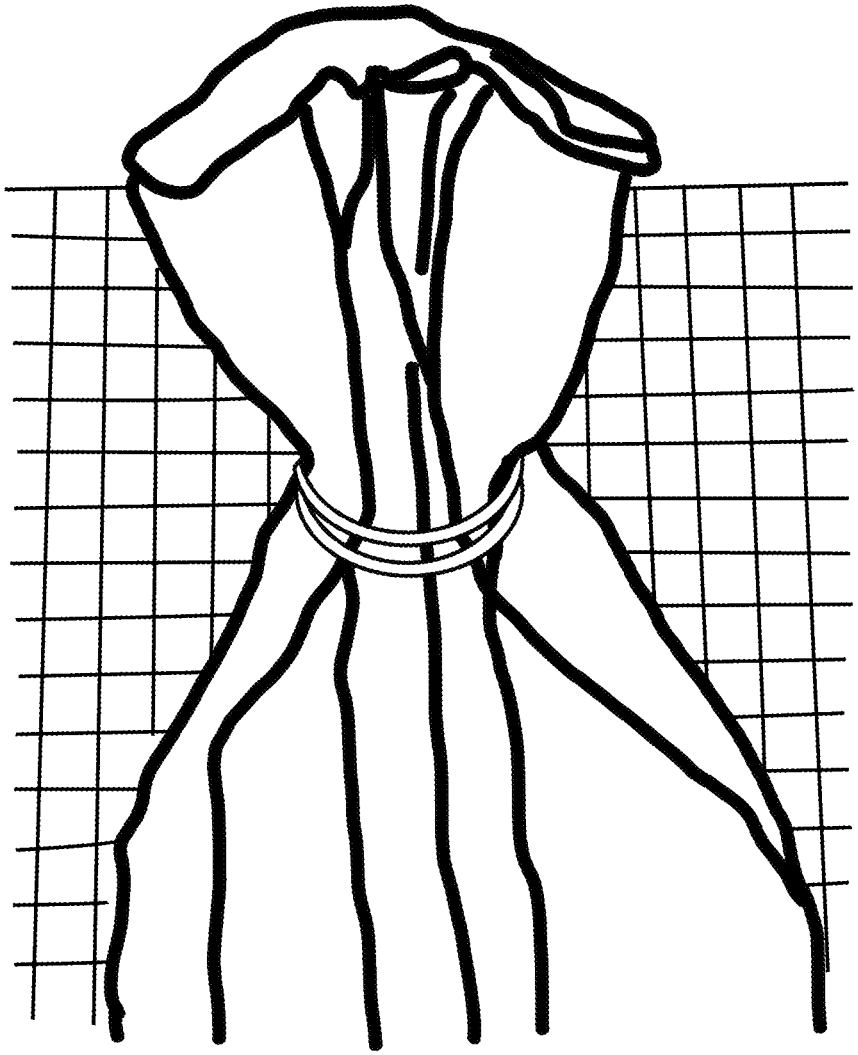
FIG. 14 illustrates the folded fabric having been gathered and threaded through a pair of connecting rings according to an embodiment.
Figure 15:
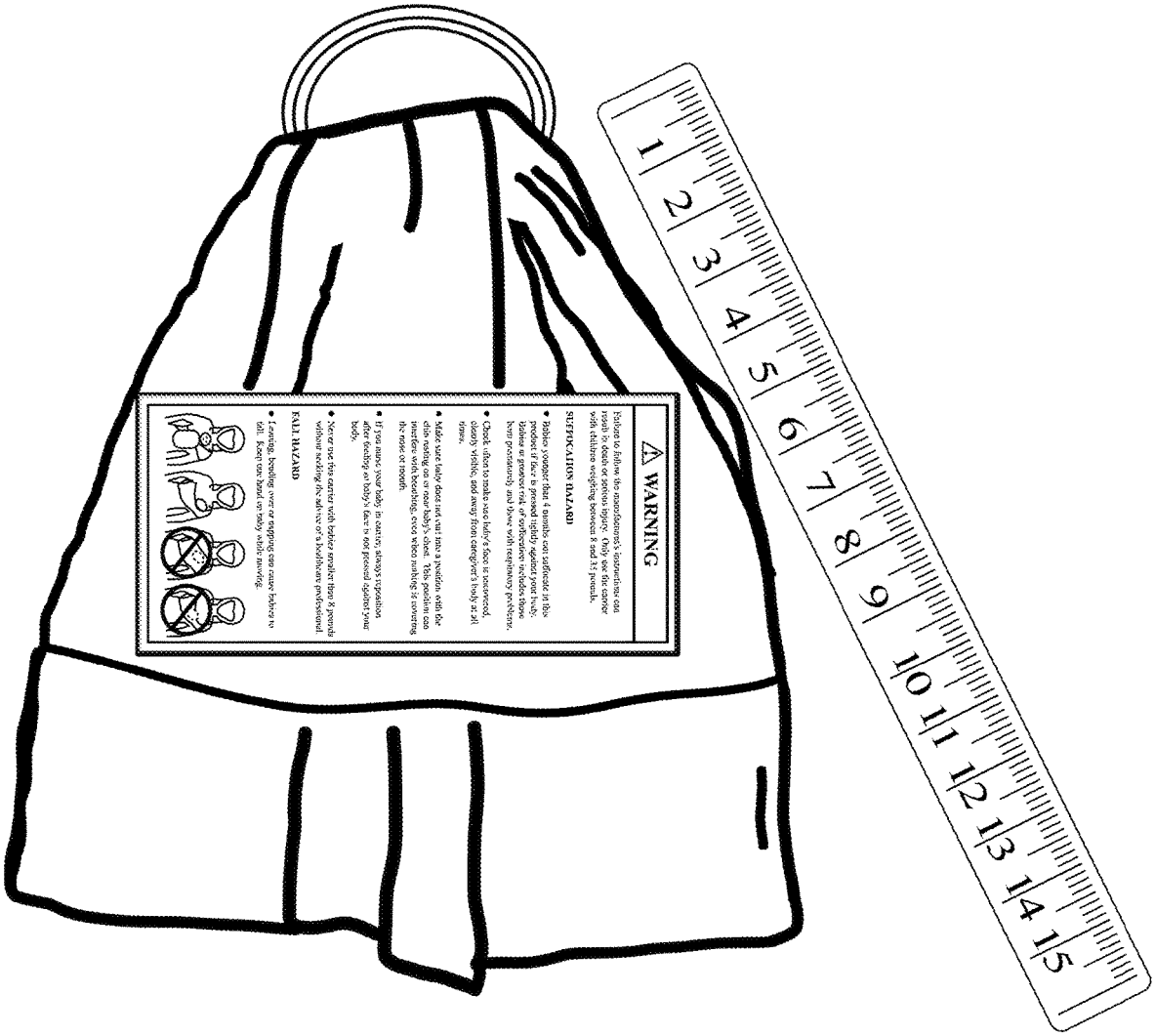
FIG. 15 illustrates the folded fabric that was illustrated as threaded through the connecting rings of FIG. 14 having been sewn onto itself perpendicular to the folds of FIGS. 9 and 10 about at, and parallel to, the about 16 inches marked line that was illustrated in FIG. 13 according to an embodiment.

As shown in FIG. 13, a line generally parallel with the fold of FIG. 11, is marked at about 16 inches below the top of the fold. Then, as shown in FIG. 14, the fabric is threaded through the two connecting rings. Then, as shown in FIG. 15, the fabric is folded onto itself and sewn down along the 16-inch line that was marked (per Step 6, FIG. 13).

Figure 16:
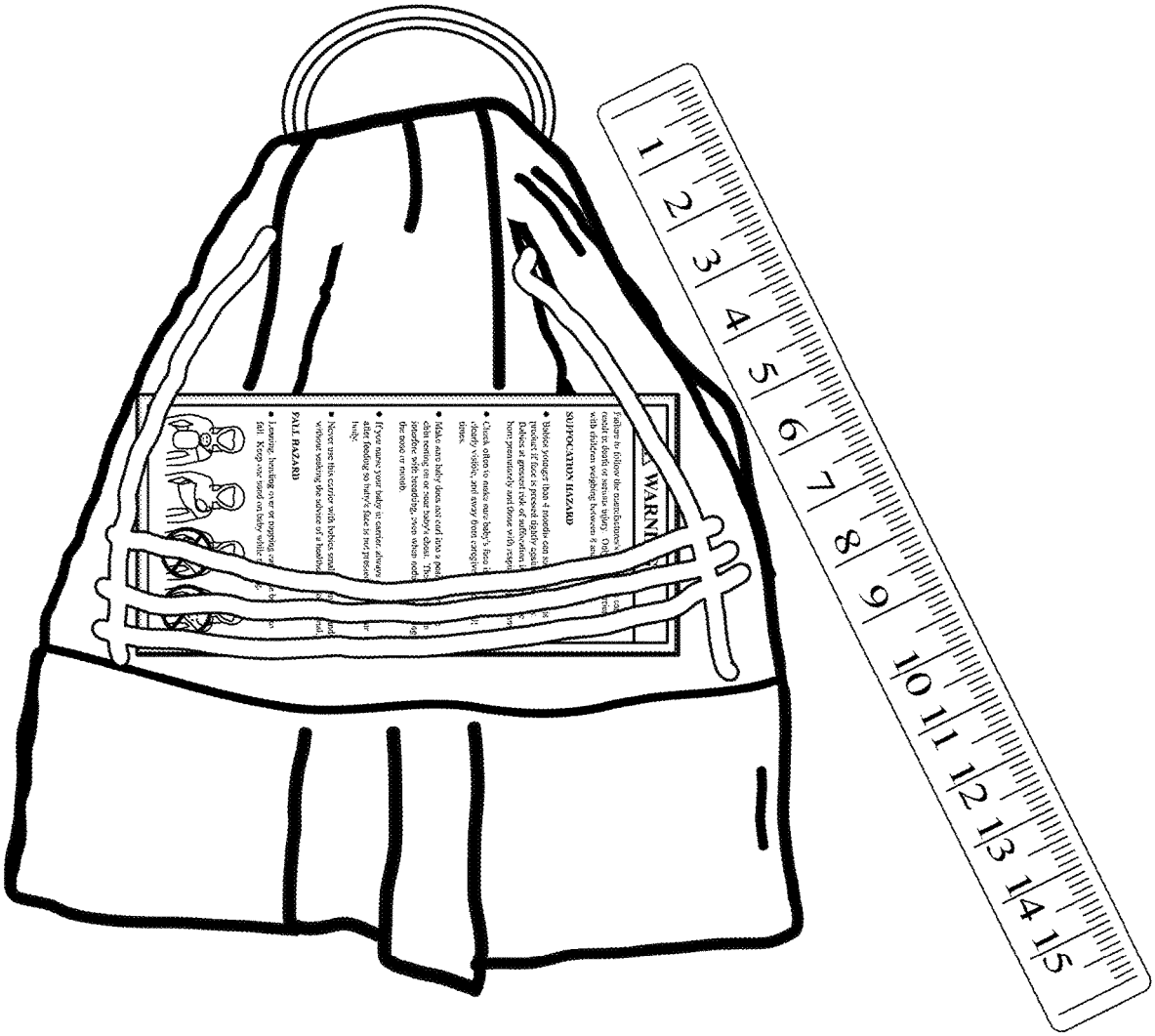
FIG. 16 illustrates the folded and sewn fabric that was illustrated in FIG. 15 being further sewn onto itself to permanently and loosely attach the fabric to the connecting rings according to an embodiment.

As shown in FIG. 16, multiple seams are sewn in the region shown over the channel like structures formed by the previous generally parallel fold to secure the fabric permanently through the connecting rings.

Figure 17:
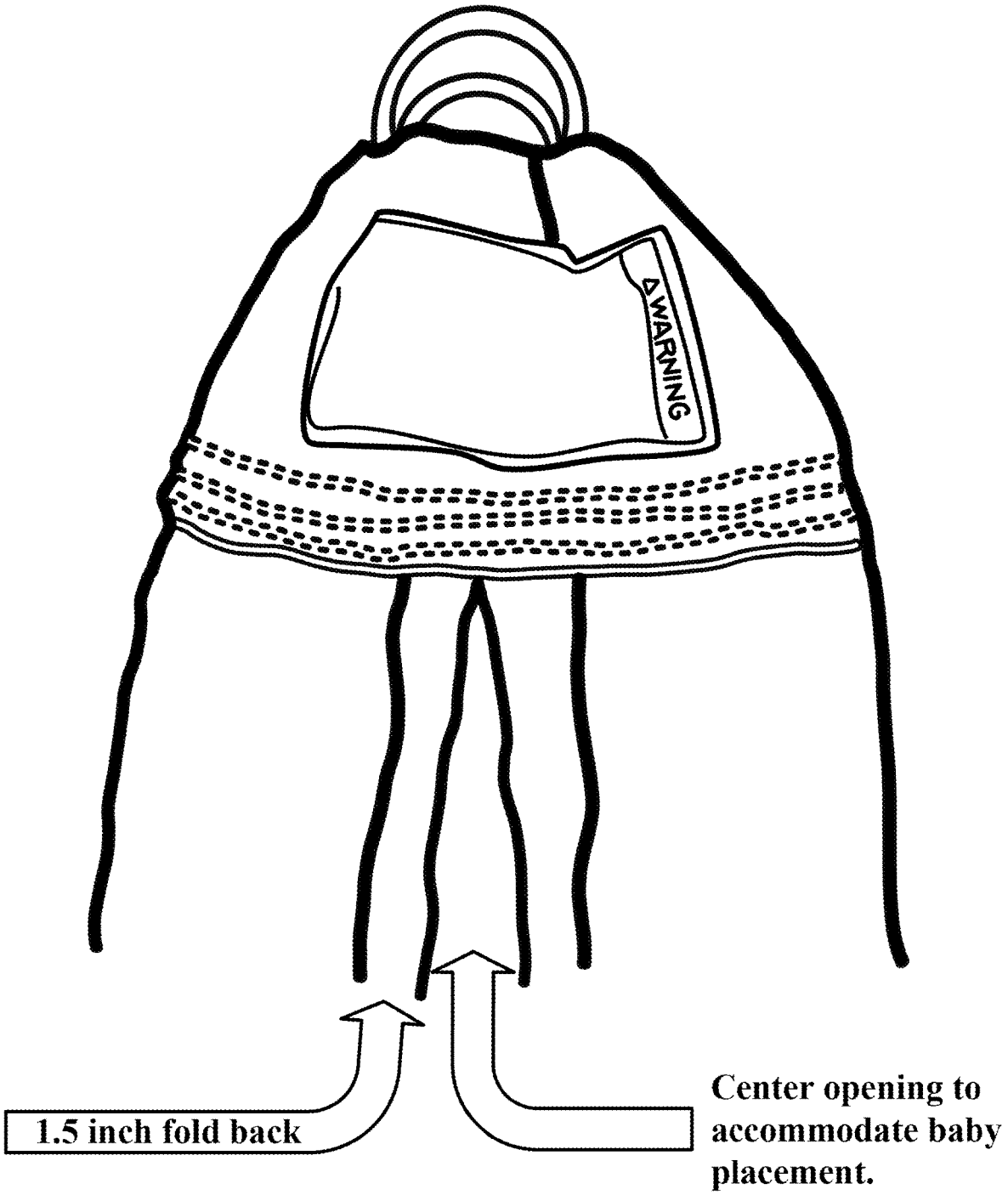
FIG. 17 illustrates an aperture formed by the edges of the 1.5 inch folded back fabric portions for accommodating a baby according to an embodiment.

As shown in FIG. 17, a center opening or aperture to accommodate baby placement is formed by the edges of the about 1.5-inch fold back shown in FIG. 10.

Figure 18:
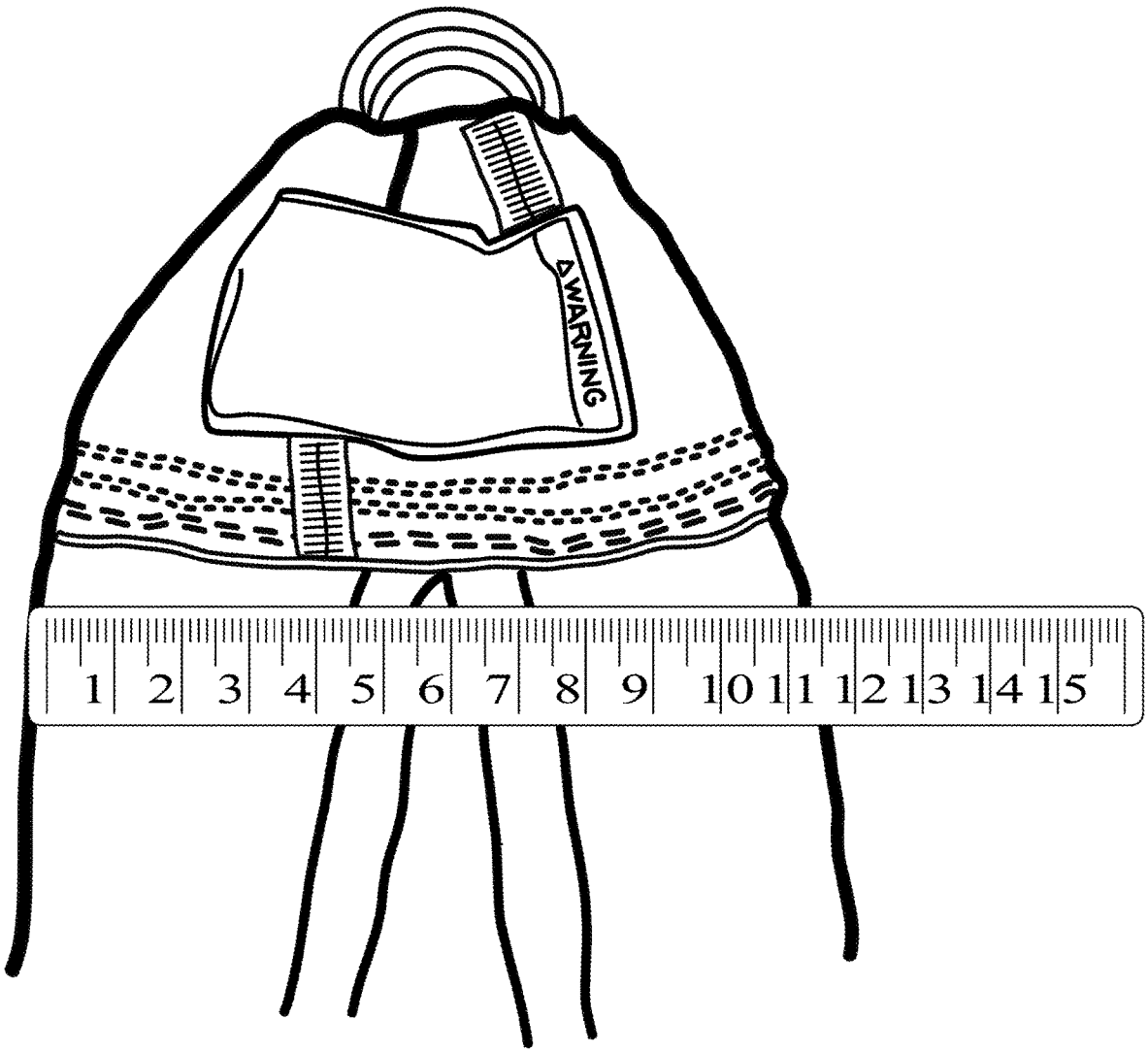
FIG. 18 illustrates doubled up layers of fabric formed by the folds to create extra cushion for a wearer according to an embodiment.

As shown in FIG. 18, the doubled-up layers of fabric create extra cushion, but advantageously without the need for any other cushioning material. When being worn, the bottom half of the sling is sewn upwards to create with a size appropriate pocket that is compatible for baby placement and secure carrying of the baby with minimal adjustment.

Thus, in summary, as described in the previous figures, in one preferred method of construction, a sling is composed of one long rectangular pieced of fabric, two rings, a safety/ warning tag, and thread for sewing. The width of sling is folded inwards towards the middle so the fabric meets in the middle. It is then folded outward so that an about 1.5 inch flap is folded back towards the edges of the sling. The fabric is pulled inward slightly more so the folded areas of fabric touch in the middle of the sling. The raw end of the fabric is folded so that the raw end of the fabric will be tucked inside the shoulder when it is threaded through the rings and sewn down. A safety warning tag is sewn on the end of the fabric. In one embodiment of the invention, the fabric is folded in two continuous folds that meet in the middle and fold optimally backward about 1.5 inches with a middle opening.

The folded fabric is then pulled through two preferably aluminum rings and pulled back down so that there is a top and bottom layer of fabric folded on itself at one end of the sling with the two aluminum rings secured in the loop they form when folded.

A seam is made up along each edge of the sling where the fabric is folded. The top and bottom layers of the sling are sewn together, preferably with a triple seam. The measurement from the bottom of the triple seam to the top of the shoulder fabric as it proceeds through rings is about 9 inches (i.e., the entire length of the sling shoulder is 9 inches tall). The resulting width shoulder is about 11 inches wide.

As shown in FIG. 19, narrowed width at the portions that pass through or are adjacent to the connecting rings means there is minimal adjustment needed once placed on the wearer's shoulder and therefore increased comfort. Narrowed width in this region means it will not press on wearer's neck or fall down their shoulder, which causes discomfort. The doubled-up layers of fabric in the shoulder area create more cushion and comfort on the shoulder of the wearer than prior slings, but without the need for additional padding material, such as foam rubber.

Narrowed width for minimal adjustment: The folded fabric creates a shoulder area that requires less adjustment than a standard sling carrier because of a narrowed width. Most ring sling shoulders are wide and bulky with lots of loose fabric that is hard to adjust and that rides up the neck or falls off the shoulder. This design is half the width of a typical baby sling so that it sits evenly on the shoulder cap without pressing up on the neck or falling down the side of the arm.

As further shown in FIG. 19, embodiments feature a pocket for baby placement in either a seated upright position or a reclining position. In some embodiments, a baby pocket is sewn in for user: In most standard designs, the user must create a hammock pocket for the baby by adjusting the fabric of the sling, which can be difficult to do correctly. In this design, the bottom half of the sling fabric is sewn upwards running horizontally to create a pocket or hammock like area to place your baby in and hold them securely with minimal adjustment for the user. The pocket is preferably sewn upwards into the optimal size for baby placement so the user can place baby into pocket with minimal adjustment FIG. 20 shows a representative safety label with usage instructions.

Appendix A includes photographs of the sling in construction and use.

Advantages of embodiments include: (a) the sling is simple and quick to fold and sew; (b) the described sling carrier and method of construction does not add any cost to the construction because no additional materials are needed to sew a sling carrier this way.

Features of certain embodiments include: (1) Folded fabric creates 4 (or in some embodiments more or fewer) layers of fabric as a cushion on the wearer's shoulder. (2) Narrowed width of the shoulder means it requires minimal adjusting and is less bulky than prior slings. (3) The shoulder section is longer than a typical human shoulder, so the cushioning extends further behind the shoulder of the wearer and into the wearer's back for increased comfort. (4) The sling opens in the middle so it functions the same when worn on either shoulder. (5) Running horizontally, the bottom half of the sling is sewn upwards to create a pocket or hammock like area to place your baby in UPRIGHT and hold them securely. (6) The design allows the folded and sewn fabric to fan out to full width around the back for spread out and equal weight distribution.

In yet another embodiment of the invention, a shoulder design can be folded to create extra cushion with the layers of fabric and to make the shoulder area narrower. The fabric could be folded inwards towards the middle of the sling with a middle opening. In addition, the shoulder area could be extended to make it longer/taller to provide an extended area of cushioning that extended behind the shoulder of the wearer.

Most prior designs have wide bulky fabric that rides up and presses on the users neck causing discomfort as well as fall off the shoulder and riding down the arm, which can ruin the baby pocket and make the baby sit too low on the front of the wearer—resulting in an uncomfortable and less safe baby position. By folding and sewing the width of the fabric in half towards the center of the sling as described herein, it positions the fabric correctly on the shoulder cap and doesn't require the user to pull the fabric away from the neck and prevents the fabric from falling off the shoulder and down the arm. This makes it easier and safer to use with less adjustment.

This application is intended to describe one or more embodiments of the present invention. It is to be understood that the use of absolute terms, such as "must," "will," and the like, as well as specific quantities, is to be construed as being applicable to one or more of such embodiments, but not necessarily to all such embodiments. As such, embodiments of the invention may omit, or include a modification of, one or more features or functionalities described in the context of such absolute terms. In addition, the headings in this application are for reference purposes only and shall not in any way affect the meaning or interpretation of the present invention.

Although the foregoing text sets forth a detailed description of numerous different embodiments, it should be understood that the scope of protection is defined by the words of the claims to follow. The detailed description is to be construed as exemplary only and does not describe every possible embodiment because describing every possible embodiment would be impractical, if not impossible. Numerous alternative embodiments could be implemented, using either current technology or technology developed after the filing date of this patent, which would still fall within the scope of the claims.

Thus, many modifications and variations may be made in the techniques and structures described and illustrated herein without departing from the spirit and scope of the present claims. Accordingly, it should be understood that the methods and apparatus described herein are illustrative only and are not limiting upon the scope of the claims.

See Appendix A—photographs of the sling in construction and use.

What is claimed is:

1. A baby sling comprising:

a generally rectangular fabric;

folded twice lengthwise parallel along its longer dimension onto itself in its middle and folded parallel again back out towards its outer edges on each side;

then one end of the shorter dimension folded back over generally perpendicular to the previous folds and onto and itself and sewn onto itself, the one end of the shorter dimension then threaded through a pair of connecting rings;

the one end of the shorter dimension then folded over onto the folded fabric and sewn onto the folded fabric at a line marked from the one end of the shorter dimension so as to permanently and adjustably connect the connecting rings to the fabric; and thereby form an aperture for holding a baby when the sling is worn by a wearer.

* * * * *